US005207430A

United States Patent [19]

Goins

[11] Patent Number: 5,207,430

[45] Date of Patent: May 4, 1993

[54] HINGED GOLF TRAINING AID

[76] Inventor: Gary Goins, 6161 Sundown Dr., St. Peterburg, Fla. 33709

[21] Appl. No.: 721,152

[22] Filed: Jun. 26, 1991

[51] Int. Cl.[5] ..... A63B 69/36

[52] U.S. Cl. ..... 273/189 R; 273/54 B

[58] Field of Search ..... 273/189 R, 189 A, 183 B, 273/54 B; 128/879

[56] References Cited

U.S. PATENT DOCUMENTS

| | | | |
|---|---|---|---|
| 3,408,077 | 10/1968 | Norwood | 273/189 A |
| 3,423,095 | 10/1968 | Cox | 273/189 A |
| 3,606,342 | 9/1971 | Albertson | 273/189 R |
| 3,865,383 | 2/1975 | Clay et al. | 273/189 A X |
| 4,451,044 | 5/1984 | Elliott, Jr. | 273/189 A |
| 4,476,857 | 10/1984 | Levine | 273/189 A X |
| 4,682,776 | 7/1987 | Mitchell et al. | 273/189 A |

*Primary Examiner*—George J. Marlo
*Attorney, Agent, or Firm*—Dykema Gossett

[57] ABSTRACT

A unique golf training apparatus is disclosed in which an arm guide is secured to the off arm of a golfer. A wrist guide is pivotally attached to the arm guide and positioned on the hand of a golfers with no provision for securing same thereto. The pivotal attachment of the wrist guide to the arm guide ensures that the golfer's hand pivots properly relative to the forearm. The arm guide is generally C-shaped and extends over more than 180 degrees about a central axis, such that it firmly secures the golfer's arm to the arm guide. The golf training apparatus ensures the golfer will have his arm and hand properly positioned during the swing, elimi7 nating "open" or "closed" swings. This results in the golfer hitting the ball more properly.

2 Claims, 2 Drawing Sheets

HINGED GOLF TRAINING AID

BACKGROUND OF THE INVENTION

This application relates to a golf training aid or apparatus to ensure that a golfer's arm and wrist work with a proper hinging action when swinging a golf club.

During a golf swing it is known that the position of the off arm is critically important in properly addressing and hitting the ball. By the "off aim", Applicant means the left arm for a right-handed golfer, or the right arm for a left-handed golfer. The off arm must remain relatively straight throughout the swing, and not bend at the elbow. Meanwhile, the hand must pivot relative to the arm during the back swing and follow through. It is important that the hand and arm pivot relative to each other in a plane which is generally perpendicular to the ground. If the hand is bent relative to the arm such that the club is angled towards the rear of the golfer, or towards, the front of the golfer, the club head may be misaligned when the golfer follows through and strikes the golf ball. This results in a situation known as the club head being "open" or "closed", and is undesirable, resulting in hooks or slices.

Many golfers experience trouble in properly maintaining the wrists and arms in the proper positions during the swing, and thus do not properly hit the ball. It is an object of the present invention to disclose a training aid for ensuring the golfer's hand and arm pivot properly during a swing.

SUMMARY OF THE INVENTION

A disclosed training aid includes an arm guide secured to the off arm of a golfter and a wrist guide positioned adjacent the hand of the golfer. The wrist and arm guides are pivotally attached to each other at a pivot point which is roughly aligned with the golfer's wrist.

The golfer begins his back swing and eventually reaches the highest point of the back swing. The wrist guide allows the golfer's hand to pivot relative to the arm portion in the plane described above. The wrist will not pivot in any other plane since the guide portions will prevent any such movement. The golfer continues with his swing by following through and striking the ball. During this follow through, the hand again pivots relative to the arm back to a generally aligned position. Again, the wrist guide pivots on the arm guide in the proper plane. This ensures the club strikes the ball in the proper direction. The club head will not be "open" or "closed".

In further features of the present invention, the arm guide is attached through hook and loop type strips to a user. The wrist guide is unattached to the hand of the user. Further, the arm and wrist guides are preferably formed of two lamina with an outer lamina formed of a hard plastic shell, and the inner lamina formed of a softer, more resilient plastic which conforms to the individual shape of the user.

These and other objects and features of the present invention will be best understood from the following specification and drawings of which the following is a brief description.

DETAILED DESCRIPTION OF A PREFERRED EMBODIMENT

Figure 1:
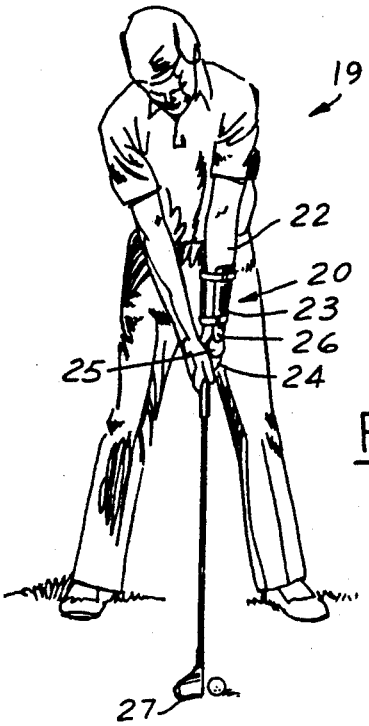
FIG. 1 is a view of a golfer wearing the present invention addressing a golf ball prior to a swing.

A typical golf swing is shown in FIG. 1 through 4. Golfer 19 is wearing a hinged golf training aid or apparatus 20. The golfer is shown as a right-handed golfer, and thus his left, or off arm 22, wears training aid 20. An arm guard 23 is mounted on the left forearm 22. The golfer's left hand 24 includes wrist guide 25. Wrist guide 25 is pivotally attached to arm guide 23 at pivot point 26, which is roughly aligned with the golfer's wrist.

Figure 2:
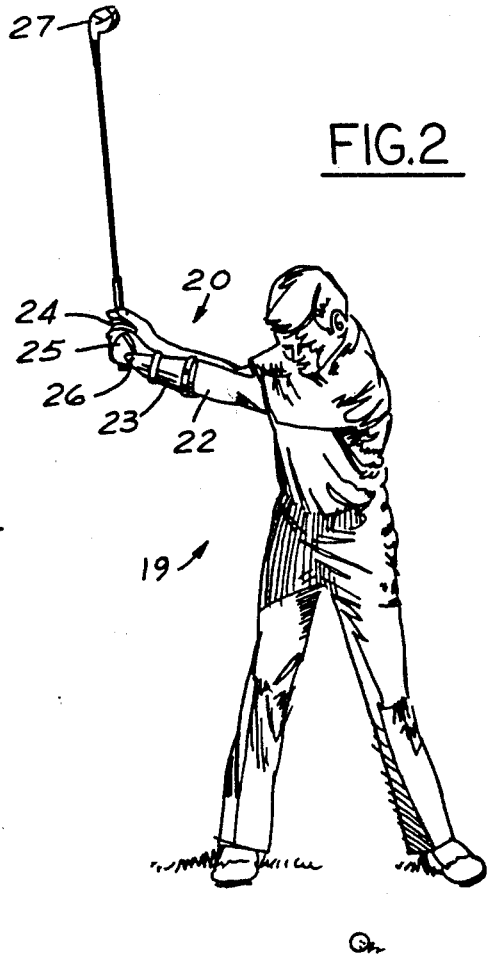
FIG. 2 is a view of the golfer during a back swing.

Golfer 19 is shown at the top of a back swing in FIG. 2. Left hand 24 has pivoted relative to left forearm 22, and wrist guide 25 has ensured that hand 24 pivots about pivot point 26. At this position it is desired that club and arm be generally in the same plane. That is, it is desirable for the golf club to generally lie in the plane of this figure. The problem discussed in the Background of the Invention section would result if the wrist breaks, and the club is angled into or out of the plane of this figure. The present invention prevents this from happening. This ensures that the pivoting of hand 24 relative to arm 22 is in the proper plane, and that the golfer's arm and hand are properly aligned at this point in the swing.

Figure 3:
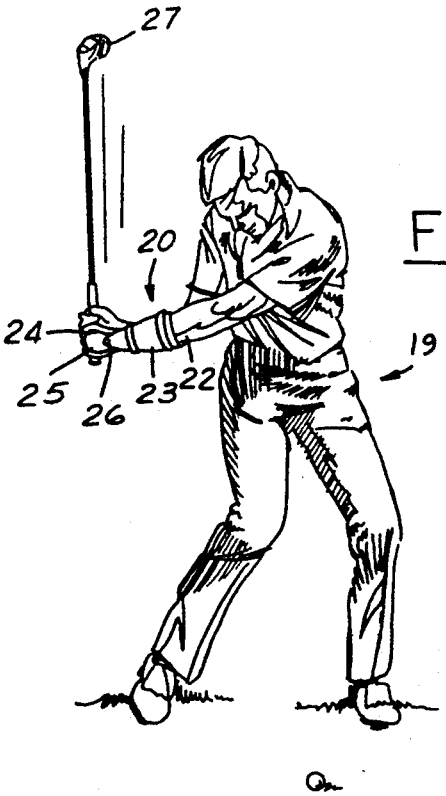
FIG. 3 is a view of the golfer beginning to follow through to strike a golf ball.

As shown in FIG. 3, golfer 19 is beginning his follow through. Hand 24 is pivoting towards an aligned position with left arm 22. Wrist guide 25 again ensures that hand 24 pivots in the proper plane.

Figure 4:
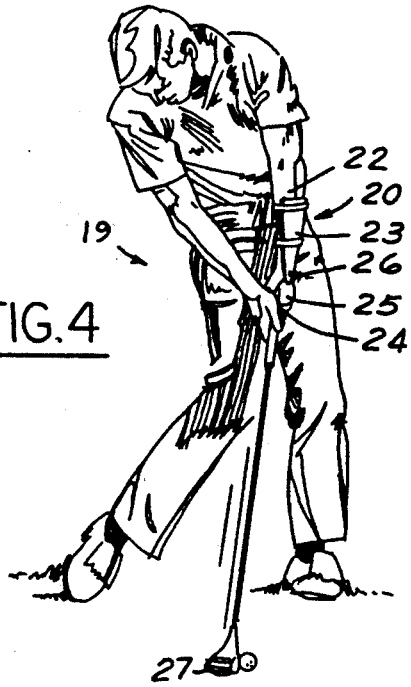
FIG. 4 is a view of the golfer immediately prior to striking a golf ball.

As shown in FIG. 4, golfer 19 is striking the ball. Arm guide 23 is aligned with wrist guide 25, ensuring the golfer's hand 24 and arm 22 are properly aligned. Club head 27 strikes the ball in the proper direction, and is neither "open" or "closed".

Figure 5:
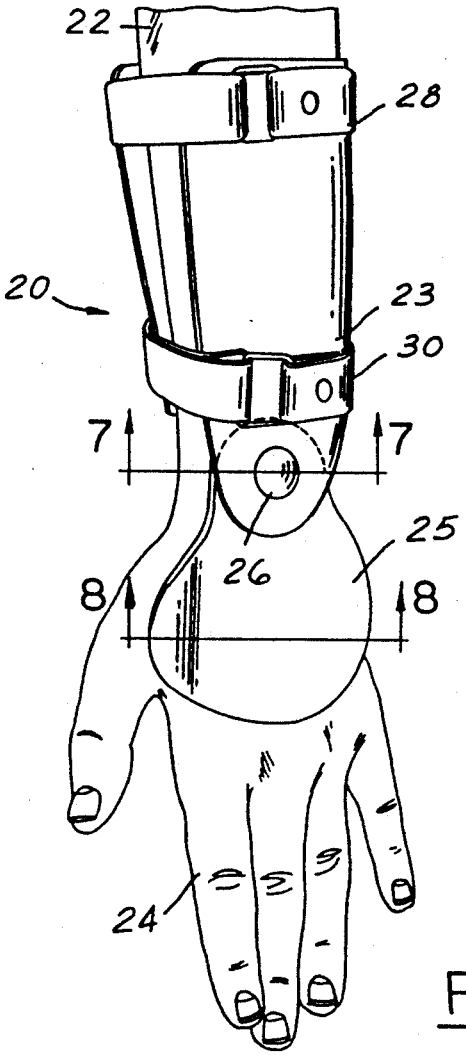
FIG. 5 is an enlarged view of a golf training aid or apparatus according to the present invention.

As shown in FIG. 5, golf training aid 20 includes arm guide 23 which is attached by hook and loop fastener strips 28 and 30 (such as Velcro TM) to left arm 22. Wrist guide 25 is left unattached on the golfer'hand 24. A pivot point 26 is formed roughly aligned with the wrist of the golfer.

Figure 6:
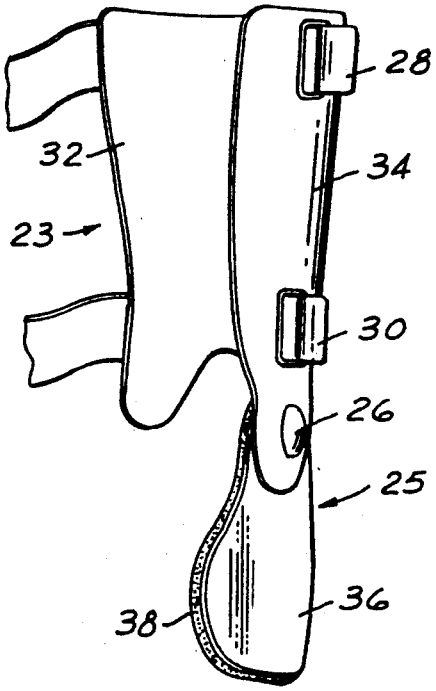
FIG. 6 is a perspective view of the golf training aid or apparatus.

FIG. 6 is a view of the golf training aid 20. Wrist guide 25 is pivotally attached to arm guide 23. Arm guide 23 includes an inner resilient material layer 32, and an outer hard plastic shell 34. Similarly, wrist guide 25 includes an outer hard plastic shell 36 overlying a softer resilient layer 38. As is clear from FIGS. 5 and 6, arm guide 23 extends over more than 180 degrees about a central axis, and is generally C-shaped in cross-sectional. This shape provides firm support of the arm, and ensures that it remains fixed relative to the arm guide as wrist guide 25 pivots relative to arm guide 23.

Figure 7:
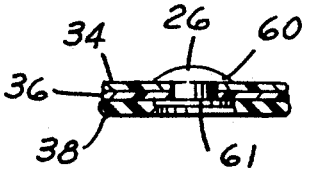
FIG. 7 is a cross-sectional view along line 7—7 as shown in FIG. 5.

FIG. 7 is a cross-sectional view through pivot point 26, showing the alignment of layers 34, 36 and 38. Pivot point 26 is tightly received within the layers 34, 36 and 38.

The pivot 26 is formed by a rivet having a head 60 and a base 61. Since layers 34 and 36 are roughly equal to the distance between the head and the base, arm guide 23 and wrist guide 25 do not flex about pivot point 26. Instead they are constrained to pivot about pivot point 26. Further, the fact that hard plastic shells 34 and 36 are in the vicinity of pivot point 26 also ensure that there is no flexing, which could result in improper pivoting. Although a single pivot point is illustrated, it should be understood that mating hand portions could be utilized on each side of the hand with separate pivot points.

Figure 8:
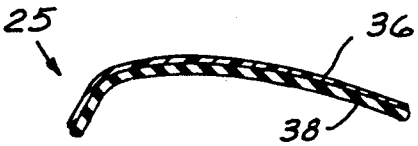
FIG. 8 is a cross-sectional view long line 8—8 as shown in FIG. 5.

FIG. 8 shows layers 36 and 38 of wrist guide 25.

Due to the above-discussed features of this invention, it is ensured that a golfer's hand 24 pivots properly relative to arm 22 during the back swing and follow through. If hand 24 begins to break at the wrist forwardly or rearwardly relative to the golfer, wrist guide 25 would prevent such movement. Even if the golfer's hand did overcome the resistance of wrist guide 25, there will be contact. This contact would give the golfer a signal that his wrist has broken and that such breaking is a problem which should be addressed.

Although wrist guide 25 lies in front of the golfer's hand at the top of the backswing, it also prevents the golfer's hand from breaking rearwardly about the wrist. If the golfer's hand begins to break rearwardly at the wrist a portion of the hand in the vicinity of the wrist does move forwardly. This portion would contact wrist guide 25, which prevents such movement.

In summary, golf training aid 20 ensures that the golfer's hand 24 pivots in the proper plane relative to the golfer's arm 22. After having worn golf training aid 20 for a period of time, the golfer will be trained to swing properly, and may no longer need training aid 20.

A preferred embodiment has been disclosed, however, a worker of ordinary skill in the art would recognize that certain modifications would come within the scope of this invention. For that reason the following claims should be studied in order to determine the true scope and content of this invention.

I claim:

1. A golf training apparatus comprising:

an arm guide adapted to be secured to the arm of a golfer, said arm guide being generally C-shaped in cross-section, and extending over more than 180 degrees about a central axis of said arm guide, at least one strap for securing said arm guide to the arm of a golfer;

a wrist guide adapted to be aligned with the hand of a golfer, with no provision for securing same thereto; and said wrist guide being pivotally attached to said arm guide such that said wrist guide may pivot relative to said arm guide, the pivotal connection of said arm guide and said wrist guide being at a pivot axis roughly aligned with a golfer's wrist.

2. The golf training apparatus as recited in claim 1, wherein there are two straps on said arm guide, spaced such that one is adjacent to said wrist guide, and the other is spaced from said wrist guide.

* * * * *